United States Patent [19]

Graillat

[11] Patent Number: 4,890,855

[45] Date of Patent: Jan. 2, 1990

[54] RELEASABLE SKI STOP

[75] Inventor: Gérard Graillat, Annecy, France

[73] Assignee: Salomon S.A., Annecy Cedex, France

[21] Appl. No.: 922,418

[22] Filed: Oct. 23, 1986

[30] Foreign Application Priority Data

Oct. 30, 1985 [FR] France ..... 85 16153

[51] Int. Cl.[4] ..... A63C 9/086

[52] U.S. Cl. ..... 280/615; 280/618

[58] Field of Search ..... 280/613, 614, 615, 617, 280/618, 633, 634, 607, 609

[56] References Cited

U.S. PATENT DOCUMENTS

| | | | |
|---|---|---|---|
| 2,245,850 | 6/1941 | Brown et al. | 280/11.35 |
| 2,534,038 | 12/1950 | Lanz | 280/618 |
| 3,145,027 | 8/1964 | Berchtond et al. | 280/618 |
| 3,438,828 | 4/1969 | Bjornestad . | |
| 3,909,025 | 9/1975 | Gertsch et al. | 280/618 |
| 4,098,522 | 7/1978 | Beyl | 280/618 |
| 4,273,355 | 6/1981 | Storandt | 280/618 |
| 4,316,618 | 2/1982 | Sampson | 280/613 |
| 4,353,576 | 10/1982 | Salomon | 280/615 |

FOREIGN PATENT DOCUMENTS

| | | |
|---|---|---|
| 0368368 | 10/1982 | Austria . |
| 1140959 | 8/1983 | Canada . |
| 0416372 | 7/1925 | Fed. Rep. of Germany . |
| 1453107 | 12/1968 | Fed. Rep. of Germany . |
| 2937341 | 4/1980 | Fed. Rep. of Germany . |
| 3310739 | 10/1983 | Fed. Rep. of Germany . |
| 0841238 | 2/1939 | France . |
| 1435195 | 6/1966 | France . |
| 2255927 | 7/1975 | France . |
| 2443853 | 7/1980 | France . |
| 2450618 | 10/1980 | France . |
| 2553669 | 4/1985 | France . |
| WO8203559 | 10/1982 | PCT Int'l Appl. . |
| 0088427 | 2/1937 | Sweden . |

*Primary Examiner*—Charles A. Marmor
*Assistant Examiner*—Richard Camby
*Attorney, Agent, or Firm*—Sandler & Greenblum

[57] ABSTRACT

A safety binding for a cross-country ski including a longitudinal rib bordered laterally by two longitudinal surfaces which are substantially planar and are adapted to engage a groove in a shoe sole. The rib is independent of and displaceable laterally with respect to the longitudinal surfaces and supports an apparatus defining a transverse journal axis around which the anterior zone of the shoe is adapted to pivot. Also provided is a locking apparatus for immobilizing the rib in a skiing position in which the rib is substantially aligned with the longitudinal axis of the ski and for permitting lateral displacement of the rib in response to a lateral force on the rib which exceeds a predetermined threshold produced by the locking apparatus. This binding has a mass and a cumbersomeness which is comparable to the mass and cumbersomeness of a conventional binding.

52 Claims, 3 Drawing Sheets

RELEASABLE SKI STOP

BACKGROUND OF THE INVENTION

1. Field of the Invention

The present invention relates to a safety binding for a cross-country ski. More particularly, the invention relates to a binding of the type comprising a longitudinal rib bordered laterally, respectively, on both sides, by two approximately planar and coplanar longitudinal surfaces with respect to which the rib forms a projection. The rib is adapted to engage an elongated groove in a sole of a shoe or boot in a position such that two elongated surfaces bordering the groove face the longitudinal surfaces. In addition, an apparatus is mounted on the rib which defines an axis of rotation around which an anterior zone of the shoe sole is adapted to pivot with respect to the rib. This axis is transverse and parallel to the longitudinal surfaces.

2. Description of Pertinent Information

Traditionally, cross-country ski bindings of the type mentioned above position the rib and the two longitudinal surfaces on a plate attached to the ski. The plate serves as an intermediate support of the shoe on the ski. Furthermore, the plate comprises means for defining the transverse axis of rotation of the anterior zone of the sole of the shoe with respect to the rib.

Normally, the plate is integrally attached to the ski in a permanent fashion, for example, by means of screws. As a result of this structure, during a twisting or torsional fall the torsional moment generated by this fall is communicated to the leg of the skier by the engagement of the groove in the sole and the rib, thereby causing an excessive moment to be applied to the leg of the skier which causes the leg to break. To minimize this risk, it has been proposed, for example in West German patent application No. 33 10739, to use a plate which can be immobilized and which can also laterally pivot with respect to the ski as soon as the sole applies a lateral force to the rib of an intensity which exceeds a predetermined threshold release value which is selected to avoid any risk of breaking the leg, thereby permitting lateral pivoting of the means for defining the axis of rotation of the anterior zone of the sole of the boot with respect to the rib.

The plate described in the West German patent marks considerable progress in the safety of such cross-country bindings. However, this plate has a certain number of disadvantages. First, the movable elements comprising the plate and the means for defining the transverse rotation axis of the anterior zone of the sole of the shoe with respect to the rib have a cumbersomeness and a mass which are not negligible. This occurs because the mechanical resistance requirements of the plate impose a certain thickness on the plate under the rib and, more importantly, under the lateral surfaces bordering the rib, in comparison with plates that are integral with the ski and which do not laterally pivot.

Second, the use of the techniques set forth in the German patent result in a substantial increase in the mass of the ski binding assembly, which adversely affects the dynamics of the ski. Furthermore, the inertia of the mobile ski binding assembly, resulting from the relatively substantial mass of the assembly, causes a certain sluggishness in the lateral release of the assembly in response to a lateral force on the binding. In addition, after lateral release there is a danger that the leg of the skier may be wounded due to the shock of the leg of the skier against a lateral projection which extends transversely to the plate.

The sluggishness of the lateral release can be partially compensated for by the interposition of a bearing or slide means between the plate and the ski. However, the use of such a compensation means has another disadvantage, namely, that of spacing the shoe further away from the ski due to the thickening of the plate particularly under the longitudinal surfaces bordering the rib. This increase in the spacing between the shoe and the ski reduces the aerodynamics of the boot-ski assembly and adversely affects the stability of the skier.

Thus, there is a need for a cross-country ski binding that will permit lateral pivoting of the rib and shoe or boot which does not increase the cumbersomeness or mass of the binding, which does not cause any sluggishness in the lateral release of the boot when excessive torsional forces are present, which reduces the danger that the skier will wound his foot on a lateral projection, and which maintains the foot of the skier close to the top surface of the ski.

SUMMARY OF THE INVENTION

It is an object of the present invention to overcome the disadvantages of the prior art by providing an apparatus which will permit lateral pivoting of the rib and the shoe, which will not increase the cumbersomeness or mass of the binding, which does not cause any sluggishness in the lateral release of the boot or shoe when excessive torsional forces are present, which reduces the danger that the skier will wound his foot on a lateral projection of the binding, and which maintains the foot of the skier close to the top surface of the ski.

It is another object of the present invention to overcome the disadvantages of the prior art while at the same time permitting the boot to be freed to be laterally displaced with respect to the ski in response to excessive forces generated during a torsional fall.

To achieve these objectives the present invention relates to an apparatus for retaining a boot on a ski comprising a first longitudinal element comprising means for engaging a groove in the sole of the boot, and means for attaching the element to the ski and for permitting displacement of the element with respect to the ski in response to a force on the element which exceeds a predetermined threshold. The attaching means comprises means for permitting lateral displacement of the element with respect to the ski in response to a lateral force on the element which exceeds a predetermined threshold. The attaching means further comprises means for preventing substantial lateral displacement of the element with respect to the ski in response to a lateral force on the element which is below the predetermined threshold.

The apparatus further comprises second and third longitudinal elements integral with the ski and positioned, respectively, anterior to and posterior of the first longitudinal element. In addition, the apparatus further comprises first and second longitudinal surfaces between which the element i positioned so that the first and second longitudinal surfaces laterally border the element. Alternatively, the ski can comprises first and second longitudinal surfaces between which the element is positioned so that the first and second longitudinal surfaces laterally border the element. In this embodiment, the invention can comprise this apparatus in combination with the ski.

The first and second longitudinal surfaces are substantially coplanar to each other and are substantially planar surfaces, and the element comprises a first rib projecting above the first and second longitudinal surfaces.

In addition, the invention can comprise the apparatus outlined above in combination with the boot. In this embodiment the groove in the boot comprises an elongated groove, and the sole further comprises two elongated surfaces bordering the groove and facing the first and second longitudinal surfaces when the rib engages the groove.

The apparatus further comprises means for journalling the anterior of the sole of the rib around a rotation axis. In addition, the boot comprises an apparatus complementary to the journalling means and positioned at the front of the sole of the boot. The journalling means comprises means for engaging the complementary apparatus, such that the journalling means and the complementary apparatus together define the rotation axis. In this embodiment the journalling means is positioned in front of the groove in the sole when the groove engages the rib. In addition, the invention can comprise this apparatus in combination with the boot.

The rotation axis defined above is transverse and parallel to the longitudinal surfaces of the ski. In addition, the apparatus comprises a cross-country ski binding and the journalling means comprises means for permitting the heel of the boot to be pivoted off the ski around the rotation axis. In addition, the rib is independent of the longitudinal surfaces of the ski, the journalling means is supported on an anterior portion of the rib, and the attaching means comprises means for immobilizing the rib with respect to the longitudinal surfaces in response to a force on the rib less than the predetermined threshold. In this embodiment the immobilizing means comprises means for laterally freeing the rib for lateral displacement with respect to the ski in response to a lateral force on the rib above the predetermined threshold.

In one embodiment the first and second longitudinal surfaces are part of the upper surface of the ski, and the invention relates to such an apparatus in combination with the ski. Alternatively, the apparatus can further comprise a plate comprising two zones, wherein said two zones comprise the first and second longitudinal surfaces.

In one embodiment the rib has a shape and dimensions such that for a given shape and dimension of the groove in the sole the rib comprises means for spacing the elongated surfaces of the sole from the first and second longitudinal surfaces when the rib engages the groove in the sole. Alternatively, the rib has a shape and dimensions such that for a given shape and dimensions of the groove in the sole the rib comprises means for permitting contact between the elongated surfaces of the sole with the first and second longitudinal surfaces when the rib engages the groove in the sole.

The apparatus further comprises anterior and posterior longitudinal elements positioned, respectively, anterior to and posterior to the first longitudinal element. In this embodiment the immobilization means comprises at least one locking apparatus which releases the element for lateral displacement in response to a force above a predetermined threshold determined by the at least one locking apparatus. The at least one locking apparatus comprises first and second portions. The first portion is attached to the rib, and the second portion is attached to one of the anterior and posterior longitudinal elements. The two portions engage one another to prevent the element from being displaced laterally unless a force acts on the element above the predetermined threshold.

In one embodiment the first portion comprises a groove and the second portion comprises a finger. Alternatively, the first portion comprises a finger and the second portion comprises a groove.

The immobilization means can also comprise first and second locking apparatus, spaced apart in the longitudinal direction from each other. The first and second locking apparatus each comprise first and second portions. The first portions of the first and second locking apparatus are attached to the element and the second portion of the first locking apparatus is attached to the anterior longitudinal element. The second portion of the second locking apparatus is attached to the posterior longitudinal element.

The immobilization means further comprises means for biasing the first portion of each of the locking apparatus into engagement with the second portion of its respective locking apparatus with a force sufficient to prevent lateral displacement of the first longitudinal element in response to a lateral force on the element below the threshold.

In one embodiment the first longitudinal element comprises first and second ends and the first portions of the first and second locking apparatus are positioned, respectively, at the first and second ends of the first longitudinal element.

The immobilization means can also comprises two locking apparatus which release the element for lateral displacement in response to a force above a predetermined threshold determined by the locking apparatus. The two locking apparatus each comprise first and second portions. The first portions of each locking apparatus are attached to the rib and the second portions of each locking apparatus are connected to different longitudinal surfaces. The two portions engage one another to prevent the element from being displaced laterally unless a lateral force acts on the first longitudinal element above the predetermined threshold.

The apparatus can further comprise first and second fixed longitudinal ribs integral with the longitudinal surfaces. The first longitudinal element is independent of the longitudinal surfaces and the second portions of the locking apparatus are positioned on different fixed longitudinal ribs. The rib comprising the first longitudinal element is adapted to be positioned in a skiing position in which the apparatus permits the boot to be attached to the ski for skiing. In the skiing position the rib comprising the first longitudinal element extends in the longitudinal direction of the ski.

In one embodiment the fixed longitudinal ribs are integral with the ski. In addition, the first and second fixed longitudinal ribs are positioned on either side of the first longitudinal element comprising the rib so that the fixed longitudinal ribs comprise longitudinal extensions of the rib when the rib is in the skiing position. The fixed longitudinal ribs extend along the majority of the length of the ski.

The two portions of each locking apparatus comprise: a transverse cutout portion; a longitudinal finger rigidly affixed to one of the fixed longitudinal ribs and the first rib; and means for biasing the finger into engagement with the cutout portion when the element is in the skiing position while permitting disengagement of the finger from the cutout portion in response to a lateral force greater than the predetermined threshold.

In one embodiment the finger comprises a convex surface in the form of a portion of a toroidal surface of revolution formed around an axis substantially perpendicular to the longitudinal surfaces and in the longitudinal median plane of the ski. The cutout portion comprises a concave shape in the form of a portion of a toroidal surface of revolution formed around an axis substantially perpendicular to the longitudinal surfaces and in the longitudinal median plane of the ski and substantially identical to the portion of the toroidal surface revolution of the finger. The finger and the cutout portion comprise a lateral pivoting axis around which the first rib pivots at the beginning of the lateral displacement of the first rib in response to a purely torsional fall. This lateral pivoting axis coincides with the axis around which the surface of revolution is formed.

The finger can also comprise a transversely extending shoulder and the transverse cutout portion can comprises a transverse shoulder for engaging the shoulder of the finger. In addition, the finger can comprise a convex surface in the form of a portion of a toroidal surface of revolution formed around an axis substantially perpendicular to the longitudinal surfaces and in the longitudinal median plane of the ski, and the cutout portion can a concave shape in the form of a portion of a toroidal surface of revolution formed around an axis substantially perpendicular to the longitudinal surfaces and in the longitudinal median plane of the ski and substantially identical to the portion of the toroidal surface revolution of the finger.

In one embodiment the convex surface of the finger and the concave surface of the cutout portion extend less than 180 degrees in a plane cross-section parallel to said longitudinal surfaces. The convex surface of the finger and the concave surface of the cutout portion extend equally on both sides of the longitudinal median plane of the ski.

In addition, the angular extension of the convex surface of the finger and the concave surface of the cutout portion in every cross-sectional plane parallel to the longitudinal median plane of the ski is greater than the angular extension of the convex surface of said finger and the concave surface of the cutout in cross-sectional planes parallel to a horizontal plane passing through the apparatus. Also, the biasing means biases the finger into engagement with the cutout portion more strongly in the vertical direction than in the lateral direction.

The apparatus also comprises means for adjusting the value of the bias of the biasing means.

In another embodiment the apparatus comprises posterior and anterior longitudinal ribs positioned, respectively, posterior to and anterior to the rib and projecting above the first and second longitudinal surfaces. In this embodiment the ski comprises a central zone to which the first rib is attached. The maximum height of the ribs is reached in this central zone of the ski. In addition, the height of the posterior and anterior longitudinal ribs decreases progressively in the longitudinal direction away from the first rib.

In another embodiment the attaching means comprises means for completely releasing the first rib from the ski in response to a force on the first rib above the predetermined threshold.

In the embodiment in which the apparatus comprises posterior and anterior longitudinal ribs positioned, respectively, posterior to and anterior to the first rib and projecting above the first and second longitudinal surfaces, the transverse cross-section of the first rib and the posterior and anterior ribs is substantially in the shape of an isosceles trapezoid whose major and minor bases face, respectively, the away from and toward the top surface of the ski.

In another embodiment in which the invention relates to the apparatus detailed above in combination with the boot the first rib is longer than the boot.

In still another embodiment the immobilization means further comprises: means for pivotally mounting the first rib on the ski around a lateral pivot axis perpendicular to the longitudinal surfaces; and means for preventing lateral pivoting of the rib around the lateral pivot axis in response to a force on the first rib below the predetermined threshold. In one embodiment the lateral pivoting axis is positioned in a central portion of the first rib. In another embodiment the lateral pivoting axis is positioned at one end of the first rib. In this latter embodiment the first rib is adapted to be positioned in a skiing position in which the apparatus permits the boot to be attached to the ski for skiing such that in the skiing position the first rib extends in the longitudinal direction of the ski. Also in this latter embodiment the one end of the first rib comprises one member selected from the group consisting of: a transverse cutout and a convex surface, and one of the longitudinal surfaces comprises the other member selected from the group. The members of the group are positioned to face one another in the longitudinal direction when the first rib is in the skiing position. Also, the members of the group comprise means for engaging each other to define during the lateral pivoting axis during the beginning of the lateral displacement of the first rib.

In another embodiment the preventing means comprises two means for engaging each other and defining the threshold. One of the two means is connected to the first rib and the other of the two means is connected to the longitudinal surfaces Also, the two means are longitudinally spaced from each other with respect to the lateral pivoting axis. Also, one of the two means connected to the rib is connected to one end of the first rib. In addition, the preventing means comprises two additional means for engaging each other and defining the threshold. One of the two additional means is connected to the other end of the first rib, and the other of the two additional means is connected to the longitudinal surfaces. The two additional means are longitudinally spaced from each other with respect to the lateral pivoting axis.

BRIEF DESCRIPTION OF THE DRAWINGS

Other characteristics and advantages of the safety binding according to the present invention will become clear from the description which follows, relating to several nonlimiting embodiments of the invention, as well as the attached drawings which form an integral part of the description and in which.

DETAILED DESCRIPTION OF PREFERRED EMBODIMENTS

The present invention provides a binding for a cross-country ski of the type indicated above, in which the rib is independent of the longitudinal surfaces and displaceable at least laterally with respect to the lateral surfaces In addition the means for defining the axis rotation of the shoe or boot are supported by the independent rib. Also provided are immobilization means for immobilizing the rib with respect to the longitudinal surfaces in a skiing position in which the rib is bordered laterally, respectively, on both sides by the longitudinal surfaces. The immobilization means is adapted to laterally free the rib for lateral displacement in response to the application of a lateral force to the rib of an intensity exceeding a predetermined threshold.

As a result of this structure, the shoe or boot can be laterally displaced with respect to the ski in response to the application of excessive lateral forces which are generated, for example, in the event of a fall involving a torsion or twisting of the leg and foot of the skier. In addition, the cumbersomeness, the mass, and the inertia of that part of the assembly that is displaceable, i.e., the rib and the means for defining the transverse axis of rotation of the anterior zone of the sole of the shoe, is much less than the cumbersomeness, the mass, and the intertia of presently known bindings which permit lateral release.

In addition, the spacing of the shoe with respect to the ski is much less than in such presently known bindings because only the rib can, if desired, be reinforced by thickening the rib. This thickening of the rib is easy to compensate for by an increase in the dimensions of the groove of the sole of the shoe. As a result, in practice, the spacing of the shoe from the ski can have a value which is entirely comparable to the spacing of the shoe from the ski in bindings that do not permit lateral release. In addition, in comparison with bindings that do not permit lateral release, the mass of the present binding has an entirely negligible increase in the mass of the ski binding assembly. These advantages are particularly substantial when, in a preferred embodiment the longitudinal surfaces are defined by two zones of an upper surface of the ski itself.

Furthermore, the reduction of the inertia of the displaceable assembly facilitates its release and, after release, reduces the danger of wounding the skier by shock, especially if one takes into account the reduction of the cumbersomeness of this movable assembly resulting from the fact that the moveable assembly is not integral with the longitudinal surfaces bordering the rib.

Figures 1, 7, 8, 9, 10:
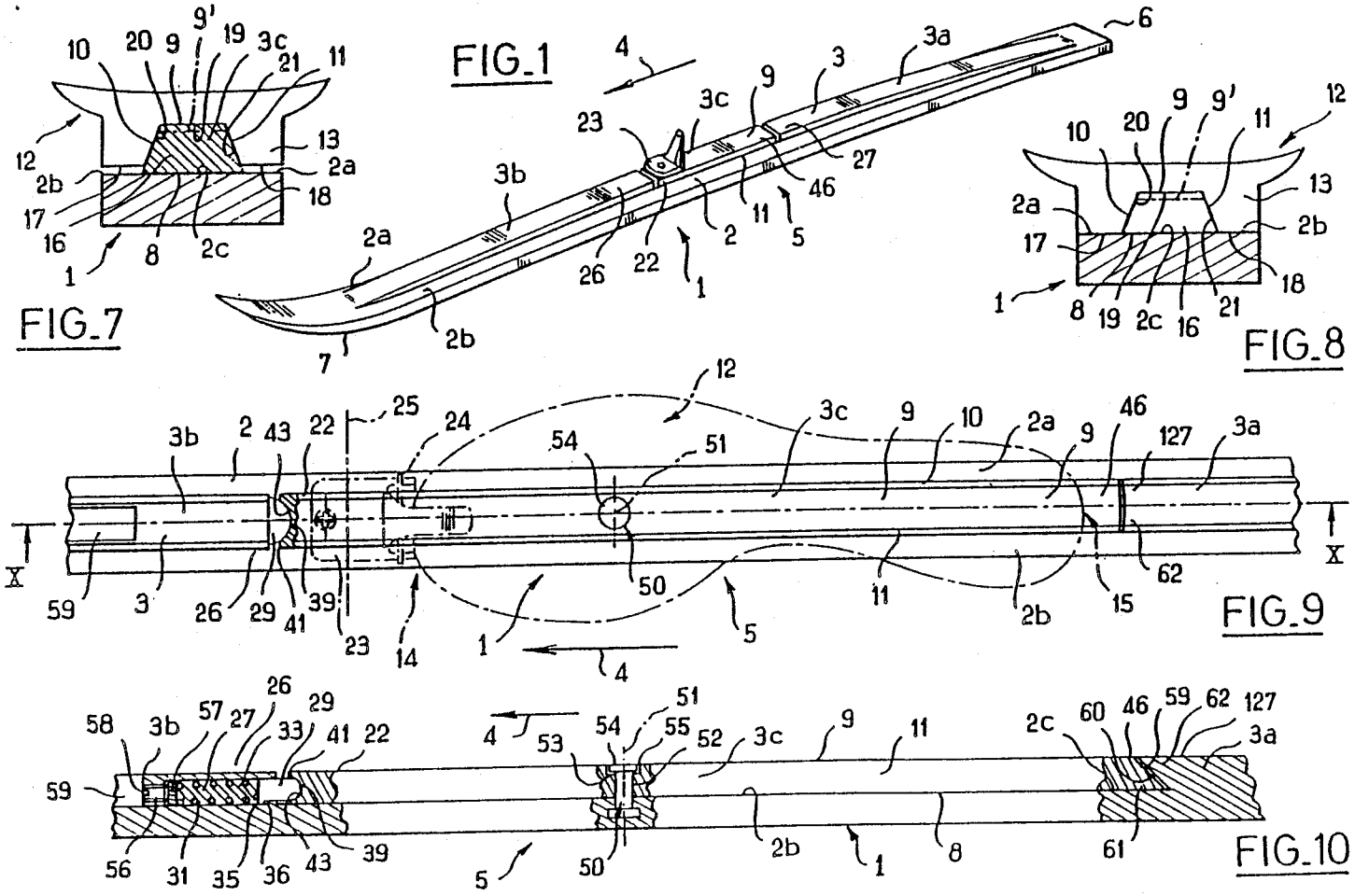
FIG. 1 illustrates a perspective view of a cross-country ski using the safety binding of the present invention.
FIG. 7 illustrates a cross-sectional view taken along plane VII—VII of FIG. 2 of the means by which the boot and binding engage each other.
FIG. 8 illustrates a cross-sectional view analogous to that shown in FIG. 7 taken along plane VII-VII of FIG. 2 of an alternative embodiment of the means by which the boot and the binding engage each other.
FIG. 9 illustrates a partial cross-sectional view analogous to that of FIG. 6 of another embodiment of a binding according to the invention.
FIG. 10 illustrates a partial cross-sectional view along the plane identified as X—X in FIG. 9.
Figures 2, 3, 4, 5, 6:
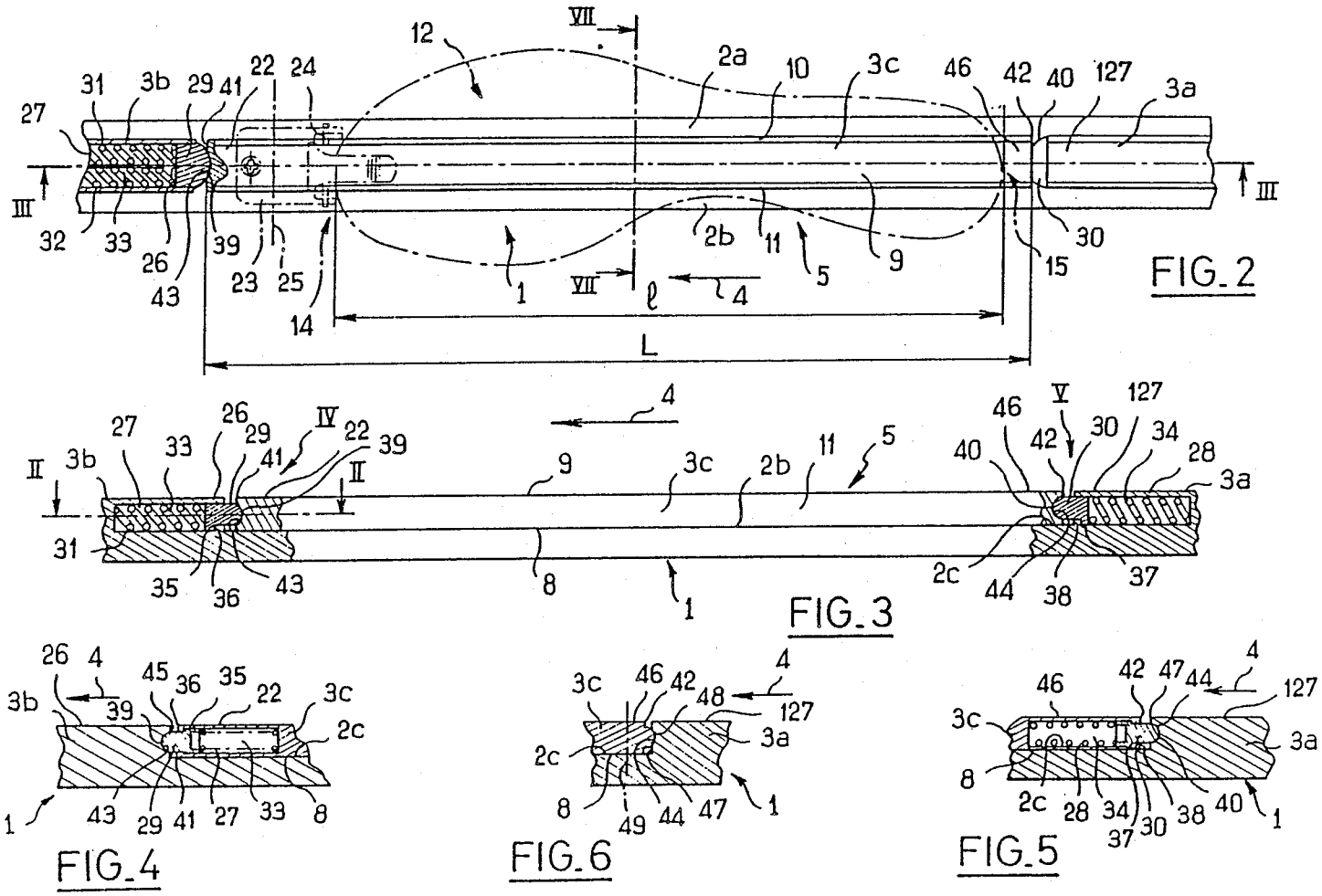
FIG. 2 illustrates a top view, partially cut-away, of a central zone of the ski positioned in the normal position of use.
FIG. 3 illustrates a partial cross-sectional view taken along line III—III in FIG. 2.
FIGS. 4 and 5 illustrate partial cross-sectional views analogous to those of FIG. 3 of alternative embodiments of portions of the binding positioned at points IV and V, respectively, in FIG. 3.
FIG. 6 illustrates a partial cross-sectional view analogous to the view shown in FIG. 5 of another alternative embodiment of that portion of the binding designated by arrow V in FIG. 3.
Figure 11:
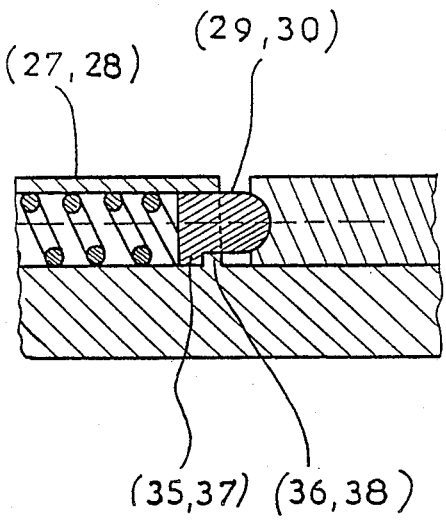
FIG. 11 illustrates a partial cross-sectional view of a portion of FIG. 3 in an enlarged scale.

Referring to FIG. 1, a cross-country ski 1 is shown in a general fashion having a generally known configuration. Ski 1 comprises a surface 2 comprising the upper surface of ski 1 when ski 1 occupies its normal use position. Upper surface 2 comprises a rib 3 extending longitudinally with respect to the normal direction 4 of displacement of the ski along the major portion of the length of the ski. Rib 3 forms a projection with respect to surface 2. Rib 3 has a maximum height in a central zone 5 of the ski. Rib 3 is adapted to receive a ski shoe 12 as illustrated in FIG. 2, and as will be explained in more detail below. The height of rib 3 decreases progressively in the longitudinal direction of ski 1 until disappearing towards posterior end 6 and anterior end 7 of the ski. Also provided are two longitudinal surfaces or strips 2*a* and 2*b* of surface 2 positioned laterally immediately adjacent on both sides of the rib 3. Strips 2*a* and 2*b* are substantially planar and coplanar in central zone 5 of the ski.

Rib 3 is subdivided into three portions or elements. One element or portion is a posterior portion, or element 3*a* which extends in the rearward direction with respect to direction 4. Another portion or element is an anterior portion or element 3*b* extending in the frontward direction with respect to direction 4. A third portion or element in positioned in central zone 5, and is a central portion or element 3*c*. While portions or elements 3*a* and 3*b* form an integral portion of ski 1, central portion or element 3*c*, normally wedged between portions or elements 3*a* and 3*b* with which it connects practically or substantially without discontinuity in a skiing position(in which the longitudinal median axis of portion 3*c* is substantially aligned with the longitudinal median axis of ski 1 or portions 3*a*,3*b*) illustrated in the figures is, on the other hand, independent of ski 1 and is adapted to be displaced at least laterally with respect to ski 1, beginning from this skiing position.

As illustrated in one embodiment shown in FIG. 7, which illustrates a cross-sectional view taken along a plane transverse to the ski at the level of portion 3*c* of rib 3, upper surface 2 extends from portion 3*a* to portion 3*b* through a zone 2*c* which is substantially planar to surfaces or zones 2*a* and 2*b*. In addition zone 2*c* is coplanar with zones 2*a* and 2*b*. Portion 3*c* of rib 3 comprises an element attached to ski 1 and resting flat on zone 2*c* of surface 2 in the skiing position. Portion 3*c* is also adapted to slide laterally on zone 2*c* and on zones 2*a* and 2*b* to leave this skiing position by such lateral displacement in response to a sufficiently large lateral force applied on portion 3*c*.

It should be noted that as seen in FIG. 7 portions 3*a*, 3*b*, and 3*c* have transverse cross-sections in the form of an isosceles trapezoid whose major base and minor base are turned respectively towards the bottom and top, that is, downwardly toward the upper surface of the ski and upwardly away from the upper surface of the ski. In the specific case of portion 3*c*, this cross-section is approximately constant and defined by a lower surface 8 which is approximately planar and rests flat on the zone 2*c* of upper surface 2 of the ski in the skiing position. In addition, lower surface 8 rests on strip 2*a* and/or strip 2*b* when portion 3*c* displaces itself laterally. In addition, portion 3*c* is also defined by an upper surface 9 which is also approximately planar and parallel to surface 8, and by two side surfaces 10 and 11 which are approximately planar and oblique with respect to surfaces 8 and which surfaces 10 and 11 connect. It should be noted that this embodiment comprises a non-limiting example of the present invention and that it is within the scope of the present invention for the transverse cross-section configuration of portions *3a, 3b,* and *3c* to have another configuration, for example triangular, with, if desired, ribs 3 of different length.

Portion *3c* of rib 3, when in the skiing position, serves to laterally retain a ski shoe or boot 12 with respect to ski 1. The boot comprises a sole 13 which has a hollowed elongated portion extending over the entire length of the shoe, i.e., from tip 14 of shoe 12 until its heel 15, in the form of an elongated groove 16 adapted to mate with portion *3c* when portion *3c* is in the skiing position. Sole 13 further comprises two elongated surfaces 17 and 18 which are substantially coplanar and planar bordering groove 16, respectively, on both sides of groove 16. When groove 16 engages rib *3c* and when rib *3c* is in its skiing position the relative positions of sole 13 and ski 1 are such that surfaces 17 and 18 face strips *2a* and *2b*. Groove 16 has a trapezoidal cross-section defined by a bottom surface 19 which is planar in the relative position of ski 1 and sole 13 noted above, which defines the bottom of groove 16, and which itself corresponds to the minor base of the trapezoid. The trapezoidal cross-section of groove 16 is also defined by two side surfaces 20 and 21 which are also approximately planar in the above discussed relative position of ski 1 and sole 13. Side surfaces 20 and 21 connect bottom surface 19, respectively, to elongated surface 17 and the elongated surface 18.

Assuming that the dimensions of sole 13, and more particularly of surfaces 17–21 are given, the transverse cross-section of the portion *3c* of the rib 3 has dimensions such that side surfaces 20 and 21 of groove 16 become flattened on surface 10 and 11 of rib *3c* in the above defined relative positions of sole 13 and ski 1. In addition, surfaces 17 and 18 of sole 13 are either spaced from longitudinal strips *2a* and *2b* of upper surface 2 of the ski, by a distance on the order of or substantially a millimeter or several millimeters as is illustrated in FIG. 7, while being parallel to strips *2a* and *2b*, or are in flattened contact with the strips *2a* and *2b* as is shown in FIG. 8. In the above defined relative position between ski 1 and sole 13 end surface 19 of groove 16 can be placed in contact with surface 9 of the portion of the rib 3 as is shown in solid lines in FIG. 7 and 8. Alternatively, groove 16 can be spaced from the upper surface of portion *3c*, the position of this upper surface being illustrated by dashed lines 9' in FIGS. 7 and 8. It should be noted that because of the substantial similarity between the embodiments of the invention illustrated in FIGS. 7 and 8, the same reference numerals have been used to designate the same elements or analogous elements in the two Figures.

When portion *3c* is in its skiing position rib *3c* has a length L greater than the length 1 of shoe or boot 6 between tip 14 and heel 15 at the level of sole 13, such that when groove 16 engages this portion *3c* as is shown in the drawings groove 16 does not cap to any extent one or the other of portions *3a* and *3b* of rib 3. In addition, there remains an anterior end zone 22 of portion *3c* that is not capped by groove 16 in front of tip 14 of boot 12, with respect to direction 4. Anterior end zone 22 supports in an integral manner an apparatus 23 which is known in itself and which cooperates with an apparatus 24 carried by tip 14 of boot 12 to define an axis of rotation 25 around which shoe 12 pivots with respect to portion *3c*. In the drawings portion *3c* is shown in the skiing position, and axis 25 is substantially transverse and parallel to strips *2a* and *2b* of upper surface 2 of the ski. It should be noted that the apparatus 23, as well as the apparatus 24 and journal axis 25 which is defined by the the cooperation of apparatus 23 and 24 are connected to portion *3c* and consequently they are displaced with portion *3c* when portion *3c* is displaced.

The apparatus is designed so that such a displacement of portion *3c* occurs only in the case of the application of a lateral force on portion *3c* of the rib 3 by means of groove 16 of sole 13 of shoe 12 having an intensity exceeding a predetermined threshold.

Locking means are thus provided to immobilize portion *3c* of rib 3 with respect to strips *2a* and *2b* of upper surface 2 of ski 1 when this portion *3c* is not subjected to such a force. These means can be of various types and particularly, as is illustrated in FIGS. 2–6, allow for a total freedom for lateral displacement and separation of portion *3c* of rib 3 with respect to the rest of the ski in response to a lateral force on portion *3c* reaches or exceeds the predetermined intensity threshold. Alternatively, as is illustrated in FIGS. 9 and 10, these various means do not allow for the lateral displacement of portion *3c* of rib 3 except in the form of a rotation with respect to the rest of the ski around an axis perpendicular to strips *2a* and *2b* of the upper surface 2 thereof.

More precisely, there has been illustrated in FIGS. 2 and 3 a first means for immobilization of portion *3c* of rib 3 with respect to strips *2a* and *2b* of upper surface 2 of the ski, or more generally with respect to the assembly thereof. According to this first embodiment, anterior portion *3b* comprises a posterior end zone 26 having an interior comprising a seat 27 in the form of a blind hole open toward the rear, i.e. toward portion *3c* when portion *3c* is in the skiing position. In addition, posterior portion *3a* comprises an anterior end zone 127 having an interior comprising a seat 28 in the form of a blind hole open toward the front, i.e. open toward portion *3c* when in the skiing position. Each seat 27 and 28 is adapted to receive and longitudinally and slidingly guide fingers 29, 30, respectively. Seat 27 also seats means 33 for elastically biasing finger 29 towards the rear, while seat 28 seats means 34 for elastically biasing finger 30 towards the front.

As is illustrated by way of non-limiting example with respect to means 33, these elastic bias means 33 and 34 comprise, for example, two helicoidal compression springs 31 and 32, longitudinally juxtaposed and interposed between the corresponding fingers such as 29 and the end of the corresponding seat such as 27; fingers 29 and 30 thus biased by means 33 and 34 tend to come out of seats 27 and 28 by longitudinal sliding in the interior of seats 27 and 28. The longitudinal path of fingers 29 and 30 with respect to portions *3b* and *3a* of rib 3 of the ski, respectively, are limited by appropriate abutment means to a value such that fingers 29 and 30 form a longitudinal projection, respectively, towards the rear and towards the front, with respect to portion *3b* of the rib 3 and with respect to portion *3c*. These abutment means can, for example, comprise complementary shoulders 35 and 36 carried, respectively, by finger 29 in front thereof and by seat 27 at the rear thereof, and by analogous shoulders 37 and 38 carried complementarily, respectively, by finger 30 in the rear thereof and by seat 28 in the front thereof. Each of these shoulders extend transversely with respect to longitudinal direction 4 of displacement of the ski.

Towards the rear and towards the front, respectively, fingers 29 and 30 have convex surfaces 39, 40, each of which has the form of a portion of a toroidal surface of revolution around an axis approximately perpendicular to strips 2*a* and 2*b* of upper surface 2 of ski 1 and situated in the longitudinal median plane of ski 1, which corresponds to the cross-sectional plane identified as III—III in FIG. 2 and which corresponds to the longitudinal plane of symmetry of the assembly of the ski, portions 3*a* and 3*b* of rib 3, as well as portion 3*c* in the skiing position.

Portion 3*c* of rib 3 comprises an anterior end surface 41 and a posterior end surface 42. In order to engage fingers 29 and 30 portion 3*c* comprises two cutouts 43, 44 positioned, respectively, in surfaces 41 and 42, respectively. These cutouts extend transversely with respect to direction 4 when portion 3*c* is in the skiing position. Each cutout has a concave shape corresponding to a portion of a surface of a toroid identical at each point to that which is defined by the convex surface 39 or 40 of the corresponding respective finger 29, 30.

Shoulders 35, 36, 37, 38 are disposed such that when portion 3*c* occupies the skiing position, means 33 and 34 maintain the respective convex surfaces 39 and 40 of fingers 29 and 30 in cutouts 43 and 44, respectively. As a result, the alignment of portion 3*c* and the boot in the skiing position with the longitudinal axis of the ski is assured during skiing.

In any cross-sectional plane parallel to strips 2*a* and 2*b* of upper surface 2, as is illustrated for example in the left-hand portion of FIG. 2 in which finger 29 and cutout 43 are seen in cross-section through such a plane identified as II—II in FIG. 3, convex surfaces 39 and 40 of fingers 29 and 30 and cutouts 43 and 44 have an angular extent which is less than 180°, and which is equally distributed on both sides of the longitudinal median plane III—III of the ski 1. Cutout 43 and cutout 44 are adapted to become disengaged from finger 29 and finger 30, respectively, resulting in a longitudinal movement of the fingers against the corresponding elastic bias means 33 and 34, by displacement of these cutouts along a direction having a component perpendicular to the longitudinal median plane III—III of the ski 1. Such a movement, signifying the liberation of the cutouts vis-a-vis the corresponding finger, is not possible except if portion 3*c* experiences a lateral force sufficient to overcome the friction between the cutouts and their corresponding finger, on the one hand, and sufficient to overcome the elastic bias of the bias means of their corresponding finger, on the other hand, in addition to the friction between portion 3*c* and zone 2*c* of upper surface 2 of the ski. If desired, this movement can be facilitated by the interposition of appropriate means between portion 3*c* and zone 2*c* of upper surface 2 of ski 1, portion 3*c* being shown in the drawings in the skiing position; these means can comprise, for example, a coating of a material such as polytetrafluorethylene, facilitating the sliding.

It should be noted that in longitudinal median plane III—III as well as in every cross-sectional plane parallel to plane III—III, convex surfaces 39, 40, fingers 29, 30 and cutouts 43, 44 have an annular extent greater than their angular extent in plane II—II or in any cross-section plane parallel to this plane. In addition, portion 3*c*, shown in the skiing position, is retained with more force in the direction of the height of the apparatus than laterally with respect to the ski shown in the normal position of use.

The threshold above which each of cutouts 43 and 44 can free themselves laterally with respect to corresponding fingers 29, 30 can be adjusted by calibration and adjustment of corresponding elastic bias means 33, 34; as will become clear below with respect to the embodiments of FIG. 9 and 10, one can for this purpose provide calibration or adjustment means for adjusting elastic bias means 33 and 34, for example, in the form of means for adjusting, at will, the apparent length of the springs 31, 32 which comprise elastic means 33, 34.

It should be noted that without going beyond the scope of the present invention one can reverse the relative positions of finger 29 biased elastically and cutout 43 in front of portion 3*c*, and one can reverse the relative positions of finger 30 biased elastically and cutout 44 at the rear of portion 3*c*, with respect to what has been described with reference to FIGS. 2 and 3. One may make such a reversal at one of the ends of portion 3*c* by repositioning the arrangement described in FIGS. 2 and 3 at the other end of portion 3*c*, or one may reverse the position the fingers and the cutouts at the two ends of portion 3*c*.

FIG. 4 illustrates the reversal of the position of finger 29 biased elastically and of cutout 43 in front of portion 3*c*. In FIG. 4, the same references numerals are used to designate elements identical to those which have been illustrated in FIGS. 2 and 3, or to designate elements functionally analogous to the elements illustrated in FIGS. 2 and 3.

The embodiment illustrated in FIG. 4 shows ski 1, central portion 3*c*, anterior portion 3*b* and zone 2*c* of the upper surface of ski 1. FIG. 4 also shows anterior end zone 22 of portion 3*c* and it is this anterior end zone 22 which is hollowed out longitudinally to form an opening 27 in the form of a blind hole positioned in zone 22. Opening 27 is open towards the front, i.e., towards portion 3*b* when portion 3*c* is in the skiing position. In the interior of opening 27 a finger is slidably longitudinally mounted. The finger comprises a convex surface facing the front, which is completely identical to surface 39 previously described. Finger 29 and seat 27 are identical to finger 29 and seat 27 that have been previously described. As a result, these elements have respective shoulders 35 and 36 which limit the sliding of finger 29 in the interior of seat 27 in a direction out of seat 27, i.e., in this embodiment towards the front. Bias means 33 is positioned in the interior of seat 27 and is, for example, in the shape of longitudinal helicoidal springs compressed between the end of seat 27 and finger 29. Finger 29 is biased elastically towards a position of maximum projection in which shoulders 35 and 36 are in mutual abutment.

In a complementary fashion, a cutout 43 which is identical at every point to cutout 43 that has been previously described is provided in a posterior end transverse surface 45 of portion 3*b*. Surface 45 faces the rear and, consequently, faces surface 41 of portion 3*c*.

The embodiment illustrated in FIG. 5 shows a reversal of the respective positions of cutout 44 and of fingers 30 in the rear of portion 3*c*. In this figure portion 3*c* and portion 3*a*, as well as zone 2*c* of the upper surface of the ski and posterior end surface 42 of portion 3*c* are illustrated. However, in contrast with the embodiment illustrated in FIG. 3, it is the interior of a posterior end zone 46 of portion 3*c*, shown in the skiing position, which is provided along the longitudinal axis of portion 3*c* with seat 28. Seat 28 is adapted to receive finger 30 and elastic means 34 therein so that finger 30 can slide longitudinally therein. Finger 30 is received in seat 28 so that the direction of maximum projection in this embodiment of finger 30 is towards the rear, out of seat 28. In order to impose a limit on the displacement of finger 30, seat 28 and finger 30 support, respectively, shoulders 38 and 37, as is also the case in the abutment described in the embodiments illustrated in FIGS. 2 and 3. In addition, finger 30 in this embodiment comprises a convex surface 40, at or toward the rear thereof, which is also identical to surface 40 which has been previously described. Surface 40 is the surface through which this finger engages a cutout 44 provided in transverse surface 47 at the front of portion 3*a*. Cutout 44 faces the front and also faces surface 42 of portion 3*c*.

One of ordinary skill in the art will understand that the alternative embodiments illustrated in FIGS. 4 and 5 operate in the fashion described with reference to the embodiments of FIGS. 2 and 3.

One of ordinary skill in the art will furthermore appreciate that out of concern for economy the embodiment shown in FIG. 6 has been developed, which is an alternative embodiment to FIG. 5. In this embodiment one of fingers 29 and 30 are not mounted to slide in a seat of a portion of the rib, but rather, one of fingers 29 and 30 are integral with portion 3*c*. In this embodiment it is not necessary to provide either a seat for the sliding of the finger, or means for elastically biasing the finger in the direction of a projection out of the seat. Thus, in the embodiment shown in FIG. 6, posterior end zone 46 of portion 3*c* comprises a convex surface 48 longitudinally projecting towards the rear with respect to transverse surface 42. Convex surface 48 is identical to each point geometrically, to surface 40 but it is fixed with respect to portion 3*c*. Surface 48 engages, when portion 3*c* is in the skiing position, a cutout 44 identical to cutout 44 described with reference to FIG. 5 and provided in an anterior end transverse surface 47 of posterior portion 3*a* of the rib of the ski. It is also within the scope of the invention to position at the level of the interior end of portion 3*c* of the rib the apparatus illustrated in FIG. 4, or the arrangement illustrated in FIGS. 2 and 3.

In embodiments of the type illustrated in FIG. 6, one of fingers 29 and 30 positioned on one or the other of the portions of the rib is affixed with respect to this portion and the other finger is displaceable with respect to this portion. In this type of embodiment the beginning of the lateral displacement of portion 3*c* occurs at the movable finger and comprises a provisional rotation of portion 3*c* around a lateral pivoting axis of portion 3*c* perpendicular to two strips 2*a* and 2*b* of the upper surface of the ski in response to a purely torsional fall. The lateral pivoting axis also substantially coincides with the axis of the toroidal surface defining both the convex surface of the fixed finger and the concave surface of the cutout with which this surface cooperates. In FIG. 6, this axis is situated substantially in longitudinal median plane III—III of the ski and perpendicular to zones 2*a*, 2*b*, 2*c* of the upper surface of the ski. This lateral rotation axis is designated by the reference numeral 49 and is situated in the posterior end zone 46 of portion 3*c*.

As soon as the lateral disengagement of portion 3*c* from rib 3 of the ski has been started by means of rotation of portion 3*c* around an axis such as 49, portion 3*c* disengages totally from the ski, which totally frees the shoe 12 from the ski, as is also the case if one uses the embodiments illustrated in FIGS. 2–5.

It should be noted that such a total liberation of portion 3*c* from the ski can also be obtained in the event of a frontward fall, which may be combined with a torsional fall. In this event it is the finger acting at the posterior end of portion 3*c* which is rendered integral with portion 3*c* as is illustrated in FIG. 6. Alternatively, in a nonillustrated embodiment, the finger is rendered integral with posterior portion 3*a* and total liberation of portion 3*c* occurs. Total liberation of portion 3*c* from the ski also occurs in the embodiments illustrated in FIGS. 2–5 because fingers 29 and 30, acting, respectively, at the anterior end and at the posterior end of portion 3*c*, are both retractable as has been described with reference to FIGS. 2–5. A forward fall thus causes a translation of portion 3*c* towards the front, causing an elastic retraction of the finger acting at the level of the anterior end of portion 3*c*, which disengages the finger from its seat acting at the level of the posterior end of this portion.

It is also within the scope of the invention to provide means for maintaining portion 3*c* connected to the ski even after lateral displacement and release, as is illustrated in FIGS. 9 and 10 to which reference is now made. In this embodiment the means connecting portion 3*c* to the ski pivotally mounts portion 3*c* to the ski so that portion 3*c* rotates around a axis of rotation relative to the ski and disposed in the longitudinal median plane of the ski, referenced at X—X in FIG. 9. Rotation axis X—X is substantially perpendicular to strips 2*a* and 2*b* of upper surface 2 of the ski as well as zone 2*c* of this upper surface.

By virtue of the substantially analogous structure between the embodiments of FIGS. 9 and 10 and the embodiments which have been described with reference to FIGS. 1–5, reference numerals have been used in FIGS. 9 and 10 that are identical to the reference numerals used in FIGS. 1–5 to designate identical or similar elements.

As in the other embodiments, FIGS. 9 and 10 show the subdivision of longitudinal rib 3 of the upper surface of the ski, in the normal position of use, into a posterior portion 3*a*, an anterior portion 3*b*, (both being integral with the ski) and a central portion 3*c*. Portion 3*c* is displaceable with respect to the ski. This structure allows upper surface 2 of the ski to particularly subsist in a central zone 5 of the ski. Zone 5 is adapted to receive a shoe 12. In addition, two lateral strips 2*a* and 2*b* are connected between portions 3*a* and 3*b* of rib 3 by a zone 2*c*. Strips 2*a* and 2*b*, in zone 5, and zone 2*c* are substantially planar and coplanar.

As has been previously discussed, portion 3*c* supports an apparatus 23 in an anterior end zone 22 of portion 3*c*. Apparatus 23 defines cojointly with a complementary apparatus 24 carried by tip 14 of the shoe, a relative pivot axis 25 around which shoe 12 is adapted to pivot on ski 1. Axis 25 is oriented substantially perpendicularly to median longitudinal plane X—X of the ski. The length L of portion 3*c*, measured at the level of upper surface 9 thereof for reasons which will become evident below, is greater than the length 1 of boot or shoe 12 between tip 14 and heel 15. As a result, when apparatus 23 and 24 are assembled and the groove in the sole of shoe 12 mates with portion 3*c*, a zone of portion 3*c* remains disengaged from the shoe both in front as well as at the rear of the shoe, with reference to the normal direction 4 of displacement of the ski.

This embodiment further includes a swivel or journal 50 for pivotally mounting portion 3*c* on ski 1 around a journal axis 51 situated substantially in longitudinal median plane X—X of the ski and extending substantially perpendicular to portion *2c*. Swivel 50 forms a projection above portion *2c* between portions *3a* and *3b* of rib 3 of the ski. Swivel 50 is integral with ski 1 and engages a complementary coaxial hole 52 provided in portion *3c* to guide portion *3c* to rotate around axis 51 with respect to the rest of ski 1. The top of swivel 50 comprises a head 54 which opens upwardly onto upper surface 9 of portion *3c*. Towards the bottom of head 54, swivel 50 comprises a shoulder 53 adapted to engage a shoulder 55 toward the top of and in hole 52 to retain portion *3c* against displacement, along axis 51, away from upper surface 2 of the ski.

The retention of portion *3c* in longitudinal alignment with portions *3a* and *3b* in the skiing position is assured, by the same means that prevents lateral displacement of portion *3c* in response to lateral forces on portion *3c* not exceeding the predetermined threshold. This means comprises elements 27, 29, 33, 35, 36, 39, 41, and 43 which are identical to those which have been described with reference to FIG. 3. These means are positioned as in the embodiment illustrated in FIG. 3, that is, these means are positioned in part in a posterior zone of anterior portion *3b*, and in part in anterior end zone 22 of portion *3c*. These elements are seen in FIG. 10. In addition, FIG. 10 also shows additional calibration adjustment means for adjusting the threshold produced by elastic bias means 33 of finger 29. This adjustment means comprises a longitudinal screw 56 positioned along the median longitudinal plane X—X of the ski, in anterior portion *3b* of rib 3. Screw 56 can be screwed in the end of opening 27 to compress the springs comprising means 33 to a greater or lesser extent, between a posterior end 57 of screw 56 and finger 29. Screw 56 comprises towards the top a head 58 adapted to permit easy rotating, at will, of screw 56 in one direction or the other. Head 58 is accessible for this purpose through a cutout 59 provided in portion *3b* immediately in front of opening 27.

It will be noted that the arrangement described with reference to FIG. 4 can also be adopted.

Towards the rear, portion *3c* in the skiing position can be connected to portion *3a* by means identical to those which have been described with reference to FIG. 3, or by means identical to those which have been described with reference to FIG. 5; one can however also use the arrangement illustrated in FIGS. 9 and 10. In this embodiment the rear end of portion *3c* comprises a surface 59 adapted to engage a complementary shaped surface at the front end of portion *3a*. Surfaces 59 and 60 extend transversely to longitudinal median plane X—X of the ski, and are substantially in the shape of frustoconical surfaces of revolution formed around axis 51, which converge upwardly in a fashion so as to define at the rear of portion *3c* a bevel 61 which engages between an anterior bevel 62 of portion *3a* and zone *2c* of the upper surface 2 of the ski to retain portion *3c* in the skiing position against zone *2c* of surface 2 without opposing lateral pivoting of portion *3c* with respect to the ski. Surfaces 59 and 60 can mutually mate in a tight fashion, with however, the possibility of relative sliding; alternatively, there can be play or clearance of less than several tenths of a millimeter between surfaces 59 and 60.

Such an arrangement can be adopted at the junction of portions *3c* and *3b* in the case where similar means to those which have been described with reference to FIG. 3 or FIG. 5 will be provided at the junction of the portions *3c* and *3a* to form at this level a lock having a release threshold.

One of ordinary skill in the art will easily understand that the embodiments of the invention which have just been described are non-limiting embodiments, and that the provisional immobilization of the movable portion of the rib of the ski can be assured by threshold release locks having a structure other than the structure described. Similarly, even though it is presently preferable to form the longitudinal surfaces which laterally border on both sides of portion *3c* in the skiing position so that these surfaces are directly integral with the ski, these surfaces can also comprise a zone of an upper surface of an independent plate which is integrally attached to the ski. This plate can be limited to a coating of a slippery material, applied to the ski.

Finally, instead of providing a rib 3 over the entire length of the ski as has been illustrated, one can limit this rib to central zone 5, i.e., to portion *3c*. In addition, if desired, one can attach a portion of the latching or locking means of the threshold release to the protuberance projecting above upper surface 2 of the ski in a localized fashion, immediately in front of portion *3c* in the skiing position and immediately to the rear of portion *3c* in the same position.

Although the invention has been described with reference to particular means, materials and embodiments it is to be understood that the invention is not limited to the particulars disclosed and extends to all equivalents within the scope of the claims.

What is claimed is:

1. An apparatus for retaining a boot on a ski comprising:

a first longitudinal element comprising means for engaging a groove in the sole of said boot; and means for attaching said element to said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds a predetermined threshold, wherein said attaching means further comprises means for preventing substantial lateral displacement of said element with respect to said ski in response to a lateral force on said element which is below said predetermined threshold, wherein said ski comprises first and second longitudinal surfaces which immediately laterally border said means for engaging said groove of said element when said element is attached to said ski, and wherein said element is not unitary with said first and second longitudinal surfaces and is displaceable at least laterally with respect to said first and second longitudinal surfaces.

2. The apparatus defined by claim 1 further comprising first and second longitudinal surfaces between which said element is positioned so that said first and second longitudinal surfaces laterally border said element.

3. The apparatus defined by claim 1 wherein said ski comprises first and second longitudinal surfaces between which said element is positioned so that said first and second longitudinal surfaces laterally border said element.

4. The apparatus defined by claim 3 in combination with said ski.

5. The apparatus defined by claim 2 wherein said first and second longitudinal surfaces are substantially coplanar to each other and are substantially planar surfaces, wherein said element comprises a first rib projecting above said first and second longitudinal surfaces.

6. The apparatus defined by claim 5 in combination with said boot, wherein said groove in said boot comprises an elongated groove, wherein said sole further comprises two elongated surfaces bordering said groove and facing said first and second longitudinal surfaces when said rib engages said groove.

7. The apparatus defined by claim 5 further comprising:

means for journalling the anterior of said sole of said boot on said rib around a rotation axis.

8. The apparatus defined by claim 7 wherein said boot comprises an apparatus complementary to said journalling means and positioned at the front of said sole of said boot, wherein said journalling means comprises means for engaging said complementary apparatus, wherein said journalling means and said complementary apparatus together defined said rotation axis, wherein said journalling means is positioned in front of said groove in said sole when said groove engages said rib.

9. The apparatus defined by claim 8 in combination with said boot.

10. The apparatus defined by claim 7 wherein said rotation axis is transverse and parallel to said longitudinal surfaces of said ski.

11. The apparatus defined by claim 10 wherein said apparatus comprises a cross-country ski binding, wherein said journalling means comprises means for permitting the heel of said boot to be pivoted off said ski around said rotation axis, wherein said rib is independent of said longitudinal surfaces of said ski, wherein said journalling means is supported on an anterior portion of said rib, wherein said attaching means comprises means for immobilizing said rib with respect to said longitudinal surfaces in response to a force on said rib less than said predetermined threshold, wherein said immobilizing means comprises means for laterally freeing said rib for lateral displacement with respect to said ski in response to a lateral force on said rib above said predetermined threshold.

12. The apparatus defined by claim 11 wherein said ski comprises an upper surface, wherein said first and second longitudinal surfaces are part of said upper surface of said ski.

13. The apparatus defined by claim 12 in combination with said ski.

14. The apparatus defined by claim 11 further comprising a plate comprising two zones, wherein said two zones comprise said first and second longitudinal surfaces.

15. The apparatus defined by claim 11 wherein said sole of said boot further includes elongated surfaces which border said groove, wherein said rib has a shape and dimensions such that for a given shape and dimension of said groove in said sole said rib comprises means for spacing said elongated surfaces of said sole from said first and second longitudinal surfaces when said rib engages said groove in said sole.

16. The apparatus defined by claim 11 wherein said rib has a shape and dimensions such that for a given shape and dimensions of said groove in said sole said rib comprises means for permitting contact between said elongated surfaces of said sole with said first and second longitudinal surfaces when said rib engages said groove in said sole.

17. An apparatus for retaining a boot on a ski comprising a cross-country ski binding, said apparatus comprising:

a first longitudinal element comprising means for engaging a groove in the sole of said boot;

anterior and posterior longitudinal elements position, respectively, anterior to an posterior to said first longitudinal element;

means for attaching said element to said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds a predetermined threshold, wherein said attaching means further comprises means for preventing substantial lateral displacement of said element with respect to said ski in response to a lateral force on said element which is below said predetermined threshold, further comprising first and second longitudinal surfaces between which said element is positioned so that said first and second longitudinal surfaces laterally border said element, wherein said first and second longitudinal surfaces are substantially coplanar, and wherein said element comprises a first rib projecting above said first and second longitudinal surfaces, wherein said attaching means comprises means for immobilizing said rib with respect to said longitudinal surfaces in response to a force on said rib less than said predetermined threshold, wherein said immobilizing means comprises means for laterally freeing said rib for lateral displacement with respect to said ski in response to a lateral force on said rib above said predetermined threshold; and means for journalling the anterior of said sole of said boot on said rib around an axis which is transverse and parallel to said longitudinal surfaces of said ski, said journalling means comprising means for permitting the heel of said boot to be pivoted off of said ski around said rotation axis, wherein said rib is independent of said longitudinal surfaces of said ski, wherein said journalling means is supported on an anterior portion of said rib;

wherein said immobilizing means comprises at least one locking apparatus which releases said element for lateral displacement in response to a force above a predetermined threshold determined by said at least one locking apparatus, wherein said at least one locking apparatus comprises first and second portions, wherein said first portion is attached to said rib, wherein said second portion is attached to one of said anterior and posterior longitudinal elements, wherein said two portions engage one another to prevent said element from being displaced laterally unless a force acts on said element above said predetermined threshold.

18. The apparatus defined by claim 17 wherein said first portion comprises a groove, wherein said second portion comprises a finger.

19. The apparatus defined by claim 18 wherein said first portion comprises a finger, wherein said second portion comprises a groove.

20. The apparatus defined by claim 17 wherein said immobilization means comprises first and second locking apparatus, spaced apart in the longitudinal direction from each other, wherein said first and second locking apparatus each comprise first and second portions, wherein said first portions of said first and second locking apparatus are attached to said element, wherein said second portion of said first locking apparatus is attached to said anterior longitudinal element, wherein said second portion of said second locking apparatus is attached to said posterior longitudinal element.

21. The apparatus defined by claim 20 wherein said immobilization means further comprises means for biasing said first portion of each of said locking apparatus into engagement with said second portion of its respective locking apparatus with a force sufficient to prevent lateral displacement of said first longitudinal element in response to a lateral force on said element below said threshold.

22. The apparatus defined by claim 20 wherein said first longitudinal element comprises first and second ends, wherein said first portions of said first and second locking apparatus are positioned, respectively, at said first and second ends of said first longitudinal element.

23. The apparatus defined by claim 11 wherein said immobilization means comprises two locking apparatus which release said element for lateral displacement in response to a force above a predetermined threshold determined by said locking apparatus, wherein said two locking apparatus each comprise first and second portions, wherein said first portions of each locking apparatus are attached to said rib, wherein said second portions of each locking apparatus are connected to different longitudinal surfaces, wherein said two portions engage one another to prevent said element from being displaced laterally unless a lateral force acts on said first longitudinal element above said predetermined threshold.

24. The apparatus defined by claim 23 further comprising first and second fixed longitudinal ribs integral with said longitudinal surfaces, wherein said first longitudinal element is independent of said longitudinal surfaces, wherein said second portions of said locking apparatus are positioned on different fixed longitudinal ribs, wherein said rib comprising said first longitudinal element is adapted to be positioned in a skiing position in which said apparatus permits said boot to be attached to said ski for skiing, wherein in said skiing position said rib comprising said first longitudinal element extends in the longitudinal direction of said ski.

25. The apparatus defined by claim 24 wherein said fixed longitudinal ribs are integral with said ski.

26. The apparatus defined by claim 25 wherein said first and second fixed longitudinal ribs are positioned on either side of said first longitudinal element comprising said rib so that said fixed longitudinal ribs comprise longitudinal extensions of said rib when said rib is in said skiing position, wherein said fixed longitudinal ribs extend along the majority of the length of said ski.

27. The apparatus defined by claim 24 wherein said two portions of each locking apparatus comprise:

a transverse cutout portion;

a longitudinal finger rigidly affixed to one of said fixed longitudinal ribs and said first rib; and means for biasing said finger into engagement with said cutout portion when said element is in said skiing position while permitting disengagement of said finger from said cutout portion in response to a lateral force greater than said predetermined threshold, wherein said finger comprises a convex surface in the form of a portion of a toroidal surface of revolution formed around an axis substantially perpendicular to said longitudinal surfaces and in the longitudinal median plane of said ski, wherein said cutout portion comprises a concave shape in the form of a portion of a toroidal surface of revolution formed around an axis substantially perpendicular to said longitudinal surfaces and in the longitudinal median plane of said ski and substantially identical to said portion of said toroidal surface revolution of said finger, wherein said finger and said cutout portion comprise a lateral pivoting axis around which said first rib pivots at the beginning of said lateral displacement of said first rib in response to a purely torsional fall, wherein said lateral pivoting axis coincides with said axis around which said surface of revolution is formed.

28. The apparatus defined by claim 24 wherein said two portions of each locking apparatus comprise:

a transverse cutout portion;

a longitudinal finger mounted to slide longitudinally; and means for biasing said finger into engagement with said cutout portion when said element is in said skiing position while permitting disengagement of said finger from said cutout portion in response to a lateral force greater than said predetermined threshold.

29. The apparatus defined by claim 28 wherein said finger comprises a transversely extending shoulder, wherein said transverse cutout portion comprises a transverse shoulder for engaging said shoulder of said finger.

30. The apparatus defined by claim 28 wherein said finger comprises a convex surface in the form of a portion of a toroidal surface of revolution formed around an axis substantially perpendicular to said longitudinal surfaces and in the longitudinal median plane of said ski, wherein said cutout portion comprises a concave shape in the form of a portion of a toroidal surface of revolution formed around an axis substantially perpendicular to said longitudinal surfaces and in the longitudinal median plane of said ski and substantially identical to said portion of said torodial surface revolution of said finger.

31. The apparatus defined by claim 30 said convex surface of said finger and said concave surface of said cutout portion extend less than 180 degrees in a plane cross-sectional parallel to said longitudinal surfaces, and wherein said convex surface of said finger and said concave surface of said cutout portion extend equally on both sides of the longitudinal median plane of said ski.

32. The apparatus defined by claim 30 wherein the angular extension of said convex surface of said finger and said concave surface of said cutout portion in every cross-sectional plane parallel to said longitudinal median plane of said ski is greater than the angular extension of said convex surface of said finger and said concave surface of said cutout in a cross-sectional planes parallel to a horizontal plane passing through said apparatus, wherein said biasing means biases said finger into engagement with said cutout portion more strongly in the vertical direction than in the lateral direction.

33. The apparatus defined by claim 28 further comprising means for adjusting the value of the bias of said biasing means.

34. An apparatus for retaining a boot on a ski comprising:

a first longitudinal element comprising means for engaging a groove in the sole of said boot;

posterior and anterior longitudinal ribs positioned, respectively, posterior to and anterior to said first rib and projecting above said first and second longitudinal surfaces, wherein said ski comprises a central zone to which said first rib is attached, wherein the maximum height of said ribs is reached in said central zone of said ski, wherein the height of said posterior and anterior longitudinal ribs decreases progressively in the longitudinal direction away from said first rib;

means for attaching said element to said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds a predetermined threshold, wherein said attaching means further comprises means for preventing substantial lateral displacement of said element with respect to said ski in response to a lateral force on said element which is below said predetermined threshold, further comprising first and second longitudinal surfaces between which said element is positioned so that said first and second longitudinal surfaces laterally border said element, wherein said first and second longitudinal surfaces are substantially coplanar, and wherein said element comprises a first rib projecting above said first and second longitudinal surfaces, wherein said attaching means comprises means for immobilizing said rib with respect to said longitudinal surfaces in response to a force on said rib less than said predetermined threshold, wherein said immobilizing means comprises means for laterally freeing said rib for lateral displacement with respect to said ski in response to a lateral force on said rib above said predetermined threshold.

35. An apparatus for retaining a boot on a ski comprising a cross-country ski binding, said apparatus comprising:

a first longitudinal element comprising means for engaging a groove in the sole of said boot;

means for attaching said element to said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds a predetermined threshold, wherein said attaching means further comprises means for preventing substantial lateral displacement of said element with respect to said ski in response to a lateral force on said element which is below said predetermined threshold, further comprising first and second longitudinal surfaces between which said element is positioned so that said first and second longitudinal surfaces laterally border said element, wherein said first and second longitudinal surfaces are substantially coplanar, and wherein said element comprises a first rib projecting above said first and second longitudinal surfaces, wherein said attaching means comprises means for immobilizing said first rib with respect to said longitudinal surfaces in response to a force on said first rib less than said predetermined threshold, wherein said immobilizing means comprises means for completely laterally releasing said first rib from said ski in response to a lateral force on said first rib above said predetermined threshold.

36. An apparatus for retaining a boot on a ski comprising:

a first longitudinal element comprising means for engaging a groove in the sole of said boot;

means for attaching said element to said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds a predetermined threshold, wherein said attaching means further comprises means for preventing substantial lateral displacement of said element with respect to said ski in response to a lateral force on said element which is below said predetermined threshold, further comprising first and second longitudinal surfaces between which said element is positioned so that said first and second longitudinal surfaces laterally border said element, wherein said first and second longitudinal surfaces are substantially coplanar, and wherein said element comprises a first rib projecting above said first and second longitudinal surfaces, wherein said attaching means comprises means for immobilizing said rib with respect to said longitudinal surfaces in response to a force on said rib less than said predetermined threshold, wherein said immobilizing means comprises means for laterally freeing said rib for lateral displacement with respect to said ski in response to a lateral force on said rib above said predetermined threshold; and posterior and anterior ribs positioned, respectively, posterior and anterior to said first rib and projecting above said first and second longitudinal surfaces, wherein the transverse cross-section of said first rib and said posterior and anterior ribs is substantially in the shape of an isosceles trapezoid whose major and minor bases face, respectively, away from and toward the top surface of said ski.

37. An apparatus for retaining a boot on a ski in combination with said boot comprising:

a first longitudinal element comprising means for engaging a groove in the sole of said boot;

means for attaching said element to said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds a predetermined threshold, wherein said attaching means further comprises means for preventing substantial lateral displacement of said element with respect to said ski in response to a lateral force on said element which is below said predetermined threshold, further comprising first and second longitudinal surfaces between which said element is positioned so that said first and second longitudinal surfaces laterally border said element, wherein said first and second longitudinal surfaces are substantially coplanar, and wherein said element comprises a first rib projecting above said first and second longitudinal surfaces, wherein said attaching means comprises means for immobilizing said rib with respect to said longitudinal surfaces in response to a force on said rib less than said predetermined threshold, wherein said immobilizing means comprises means for laterally freeing said rib for lateral displacement with respect to said ski in response to a lateral force on said rib above said predetermined threshold, and wherein said first rib is longer than said boot.

38. The apparatus defined by claim 11 wherein said immobilization means further comprises:

means for pivotally mounting said first rib on said ski around a lateral pivot axis perpendicular to said longitudinal surfaces; and means for preventing lateral pivoting of said rib around said lateral pivot axis in response to a force on said first rib below said predetermined threshold.

39. The apparatus defined by claim 38 wherein said lateral pivoting axis is positioned in a central portion of said first rib.

40. The apparatus defined by claim 38 wherein said lateral pivoting axis is positioned at one end of said first rib.

41. The apparatus defined by claim 40 wherein said first rib is adapted to be positioned in a skiing position in which said apparatus permits said boot to be attached to said ski for skiing, wherein in said skiing position said first rib extends in the longitudinal direction of said ski wherein said one end of said first rib comprises one member selected from the group consisting of: a transverse cutout and a convex surface, wherein one of said longitudinal surfaces comprises the other member selected from said group, wherein said members of said group are positioned to face one another in the longitudinal direction when said first rib is in said skiing position, wherein said members of said group comprise means for engaging each other to define during said lateral pivoting axis during the beginning of said lateral displacement of said first rib.

42. The apparatus defined by claim 38 wherein said preventing means comprises two means for engaging each other and defining said threshold, wherein one of said two means is connected to said first rib, wherein the other of said two means is connected to said longitudinal surfaces, wherein said two means are longitudinally spaced from each other with respect to said lateral pivoting axis.

43. The apparatus defined by claim 42 wherein said one of said two means connected to said rib is connected to one end of said first rib.

44. The apparatus defined by claim 43 wherein said preventing means comprises two additional means for engaging each other and defining said threshold, wherein one of said two additional means is connected to the other end of said first rib, wherein the other of said two additional means is connected to said longitudinal surfaces, wherein said two additional means are longitudinally spaced from each other with respect to said lateral pivoting axis.

45. A binding for detachably connecting a boot to a ski having a longitudinal upper surface, said binding comprising:

(a) an elongated rib to which the sole of the boot is adapted to be secured by means of said rib being received within a groove of the boot, said rib having axial ends;

(b) a first element mounted to said ski anteriorly of said rib and a second element mounted to said ski posteriorly of said rib, each said element including a ski connection means, each of said first element and said second element having a height substantially no greater than that of said rib;

(c) rib connection means at each axial end of said rib for attaching said rib to said ski when said rib is aligned with said surface, each rib connection means including a portion on each axial end of said rib for respective connection to said first element and said second element of said ski connection means; and (d) each of said portions of said rib connections means comprising recess means in an axial end of said rib, and each of said portions of said ski connection means comprising a movable finger, and a spring action on said finger for resiliently urging the same into the recess means on said rib whereby said rib is adapted to be detachably secured to said ski;

(e) said recess means, said finger, and said spring of each connection means being constructed and arranged to retain said rib to said ski in the presence of a lateral force on said rib which is transverse to the longitudinal direction of said rib and which is less than a predetermined value.

46. An apparatus for retaining a boot on a ski comprising:

a first longitudinal element comprising means for engaging a groove in the sole of said boot, said means for engaging said groove having a width less than that of said ski such that said ski has first and second longitudinal surfaces between which said means for engaging said groove is positioned so that said first and second longitudinal surfaces immediately laterally border said means for engaging said groove;

means for attaching said ski and for permitting displacement of said element with respect to said ski in response to a force on said element which exceeds a predetermined threshold, wherein said attaching means comprises means for permitting lateral displacement of said element with respect to said ski in response to a lateral force on said element which exceeds said predetermined threshold, and wherein said attaching means further comprises means for preventing substantial lateral displacement of said element with respect to said ski in response to a lateral force on said element which is below said predetermined threshold.

47. The apparatus defined by claim 46 wherein said groove in the sole of said boot has a predetermined width and wherein said element further has a width substantially equal to said width of said groove.

48. The apparatus defined by claim 46 wherein said groove has a predetermined transverse cross-sectional shape, and wherein said element has a complementary transverse cross-sectional shape.

49. The apparatus defined by claim 1 wherein said element further comprises a lower surface for resting upon an upper surface of said ski, said lower surface of said element being slidable transversely in a given substantially linear direction along its entire length relative to said upper surface of said ski.

50. The apparatus defined by claim 1 wherein said element is not adapted to be fixed to said ski about an axis of rotation.

51. The apparatus defined by claim 1 wherein said element further comprises a continuous, uninterrupted lower surface.

52. An apparatus for retaining a boot on a ski, the boot having a sole with a groove and lateral support surfaces adjacent the groove, the apparatus comprising:

(a) an elongated rib having a first portion configured and arranged to be received in the groove of the boot for securing the boot to the ski, so that said apparatus has substantially no mass between said lateral support surfaces of the boot and the upper surface of the ski, said elongated rib comprising a second portion axially adjacent, aligned and mounted anteriorly of said first portion, and a third portion axially adjacent, aligned and mounted posteriorly of said first portion, wherein said second portion and said third portion have cross-sectional shapes and dimensions substantially the same as the cross-sectional shape and dimensions of said first portion such that each of said first, second, and third portions of said elongated rib have substantially the same height and width at least in adjacent areas between said first portion and said second portion and between said first portion and said third portion; and (b) means for connecting said first portion of said elongated rib to said second portion of said elongated rib and to said third portion of said elongated rib at said adjacent areas, said connecting means being constructed and arranged to retain said first portion of said elongated rib fixed relative to the ski but to permit said first portion to move relative to the ski in response to a force which exceeds a predetermined threshold value.

* * * * *